US009247352B2

(12) United States Patent
Puder et al.

(10) Patent No.: US 9,247,352 B2
(45) Date of Patent: Jan. 26, 2016

(54) METHOD FOR OPERATING A HEARING AID AND CORRESPONDING HEARING AID

(75) Inventors: Henning Puder, Erlangen (DE); Andre Steinbuss, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 319 days.

(21) Appl. No.: 13/816,078

(22) PCT Filed: Aug. 9, 2010

(86) PCT No.: PCT/EP2010/061546

§ 371 (c)(1),
(2), (4) Date: Feb. 8, 2013

(87) PCT Pub. No.: WO2012/019636

PCT Pub. Date: Feb. 16, 2012

(65) Prior Publication Data

US 2013/0142368 A1 Jun. 6, 2013

(51) Int. Cl.
*H04R 25/00* (2006.01)

(52) U.S. Cl.
CPC ..... *H04R 25/48* (2013.01); *H04R 25/456* (2013.01); *H04R 25/656* (2013.01); *H04R 25/554* (2013.01); *H04R 25/652* (2013.01); *H04R 2460/05* (2013.01); *H04R 2460/11* (2013.01)

(58) Field of Classification Search
USPC ..... 381/375, 376, 312, 313
See application file for complete search history.

(56) References Cited

U.S. PATENT DOCUMENTS

| | | | | |
|---|---|---|---|---|
| 7,227,968 | B2 | 6/2007 | van Halteren | |
| 7,425,196 | B2 | 9/2008 | Jorgensen et al. | |
| 8,312,960 | B2 | 11/2012 | Keady | |
| 2002/0196958 | A1 * | 12/2002 | Halteren et al. | 381/328 |
| 2009/0028356 | A1 | 1/2009 | Ambrose et al. | |
| 2009/0264161 | A1 * | 10/2009 | Usher et al. | 455/570 |
| 2010/0177918 | A1 | 7/2010 | Keady et al. | |
| 2010/0322454 | A1 | 12/2010 | Ambrose et al. | |

FOREIGN PATENT DOCUMENTS

| | | | |
|---|---|---|---|
| WO | 2009/105677 | A1 | 8/2009 |
| WO | 2010/132359 | A2 | 11/2010 |

* cited by examiner

*Primary Examiner* — Duc Nguyen
*Assistant Examiner* — Phan Le
(74) *Attorney, Agent, or Firm* — Laurence Greenberg Werner Stemer; Ralph Locher

(57) ABSTRACT

A hearing aid and a method for operating a hearing aid to improve the quality of the hearing aid, in particular depending on the situation, include a hearing aid component that can be worn in a human auditory canal and a balloon, the size of which can be changed and which at least partially encloses the hearing aid component. During the operation of the hearing aid, a value specific to the current hearing situation is detected by the hearing aid. The size of the balloon is then set according to the determined value.

7 Claims, 2 Drawing Sheets

METHOD FOR OPERATING A HEARING AID AND CORRESPONDING HEARING AID

BACKGROUND OF THE INVENTION

Field of the Invention

The present invention relates to a method for operating a hearing aid, said hearing aid comprising a hearing aid component that can be worn in a human auditory canal and a balloon, the size of which can be changed and which at least partially encloses the hearing aid component. The present invention further relates to a corresponding hearing aid.

Hearing aids are portable hearing devices that provide support for people who are hard of hearing. In order to accommodate the numerous individual needs, various design formats of hearing aids are available, such as behind-the-ear (BTE) hearing aids, hearing aids with an external receiver (RIC: receiver in the canal) and in-the-ear hearing aids (ITE), e.g. including concha hearing aids or complete-in-the-canal hearing aids (ITE, CIC). The hearing aids cited by way of example are worn on the outer ear or in the auditory canal. Bone conduction hearing aids, implantable or vibrotactile hearing aids are also available. The stimulation of the damaged hearing is either mechanical or electrical in this case.

Hearing aids generally comprise an input converter, an amplifier and an output converter as main components. The input converter is usually a sound receiving unit, e.g. a microphone, and/or an electromagnetic receiving unit, e.g. an induction coil. The output converter is normally embodied as an electroacoustic converter, e.g. miniature loudspeaker, or as an electromagnetic converter, e.g. bone conduction headphone. The amplifier is usually integrated in a signal processing unit. This basic structure is illustrated in FIG. 1 with reference to the example of a behind-the-ear hearing aid. One or more microphones 2 for receiving the sound from the environment are incorporated in a hearing aid housing 1 that is worn behind the ear. A signal processing unit 3, which is likewise integrated in the hearing aid housing 1, processes and amplifies the microphone signals. The output signal of the signal processing unit 3 is transferred to a loudspeaker or receiver 4, which outputs an acoustic signal. The sound is optionally transferred to the eardrum of the instrument wearer via a sound tube that is fixed in the auditory canal by means of a molded earpiece. The energy supply of the hearing aid and in particular that of the signal processing unit 3 is provided by means of a battery 5 that is likewise integrated in the hearing aid housing 1.

The ventilation of the auditory canal when a hearing aid is worn is usually an important objective when adapting a hearing aid. A so-called 'vent' should therefore ensure that an exchange of air still occurs in the auditory canal if a hearing aid or a hearing aid component is positioned in the auditory canal. If e.g. an ITE hearing aid or an earpiece of an RIC device is positioned in the auditory canal, care is usually taken to ensure that a so-called open supply is achieved by means of a vent during normal operation, in order thereby to avoid any occlusion effects.

In most hearing situations, however, an open vent (i.e. a pressure-equalization facility or air-exchange facility) is primarily desirable when the hearing aid wearer is speaking. A closed vent is advantageous in environments where interference noise is present, since the interference noise cannot then reach the eardrum directly. In this case, only interference noise that has been reduced by means of e.g. bidirectional processing reaches the eardrum from the hearing aid.

It is also advantageous to close the vent in the case of so-called audio reception applications. For example, this relates to hearing situations in which the hearing aid wearer uses a telephone or receives music signals for the hearing aid via an electromagnetic connection. Direct low-frequency sound is then lost, however.

Hearing aid acousticians customarily select a specific vent for the hearing aid wearer during an initial adaptation of the hearing aid. This vent is typically a compromise between the sound quality of in particular the speech of the wearer on the one hand, and the comprehensibility of speech in interference noise on the other hand.

The publication U.S. Pat. No. 7,227,968 B2 discloses an expansible receiver module. This can be positioned in the auditory canal and has a receiver that is capable of receiving time-dependent electrical signals and outputting corresponding output signals. An expansible element encloses the receiver housing, but has an opening such that the sound generated by the receiver can reach the eardrum.

In addition, the publication U.S. Pat. No. 7,425,196 B2 describes a balloon-encapsulated receiver for wearing in the auditory canal. Here likewise, the receiver has a receiver housing that is at least partially enclosed by an expansible arrangement. The expansible arrangement is used to suppress vibration feedback and to ensure that the hearing device can be worn comfortably.

Furthermore, the publication US 2009/0028356 A1 discloses a method by means of which an inflatable balloon can be pumped up by means of low-frequency sound. This allows e.g. acoustic devices to be adapted comfortably to an auditory canal.

BRIEF SUMMARY OF THE INVENTION

The object of the present invention is to achieve improved sound quality during the operation of the hearing aid, in particular while the hearing aid is being worn.

According to the invention, this object is achieved by a method for operating a hearing aid, said hearing aid comprising a hearing aid component that can be worn in a human auditory canal and a balloon, the size of which can be changed and which at least partially encloses the hearing aid component, wherein

- a value specific to the current hearing situation is detected by the hearing aid during the operation thereof, and
- the size of the balloon is set according to the value that has been determined.

According to the invention, provision is further made for a hearing aid comprising

- a hearing aid component that can be worn in a human auditory canal and
- a balloon, the size of which can be changed and which at least partially encloses the hearing aid component, and comprising
- a detection device for detecting a value specific to the current hearing situation during the operation of the hearing aid and
- a pump device by means of which the size of the balloon can be set according to the value that has been determined.

This means that the size of the balloon of the hearing aid and hence the size of the vent is advantageously continuously adapted to the current hearing situation. A previously unused parameter is therefore used to control the operation of the hearing aid.

In a particular application, the specific value that is detected for the current hearing situation by the hearing aid during the operation thereof relates to the presence of the voice of the wearer of the hearing aid. In particular, the balloon is made smaller when the wearer of the hearing aid is speaking. In this way, the vent between hearing aid or hearing aid component and auditory canal wall is enlarged when the voice of the actual hearing aid wearer is identified, thereby avoiding occlusion effects, in particular the increased perception of the voice signals via bone conduction.

However, the specific value can also relate exclusively or additionally to an interference noise, such that the size of the balloon is changed according to the quality or the quantity of the interference noise. It is thus possible e.g. to prevent exterior interference noise from arriving unimpeded at the eardrum.

The specific value can be determined by a classifier. For example, the specific value provides classification information which can be used to adjust the size of the balloon as appropriate.

Alternatively, the specific value can also be determined by means of a signal-to-noise ratio measurement. In this way, the size of the balloon can advantageously be continuously set as a function of the signal-to-noise ratio, for example.

However, the specific value can also be supplied by an audio receiving unit of the hearing aid. It then relates to e.g. the information that an inductively transferred telephone signal or a music signal is present.

Furthermore, the specific value can also be supplied by a feedback detector of the hearing aid. In this way, the size of the balloon can be directly set with reference to the strength of feedback.

In a particular embodiment, the hearing aid automatically learns at what time or at what specific value the balloon is made smaller, before a feedback effect occurs above a predetermined threshold. It is thereby possible to prevent feedback whistles from occurring in recurring situations.

The present invention is now explained in greater detail with reference to the appended drawings, in which:

DESCRIPTION OF THE INVENTION

Figure 1:
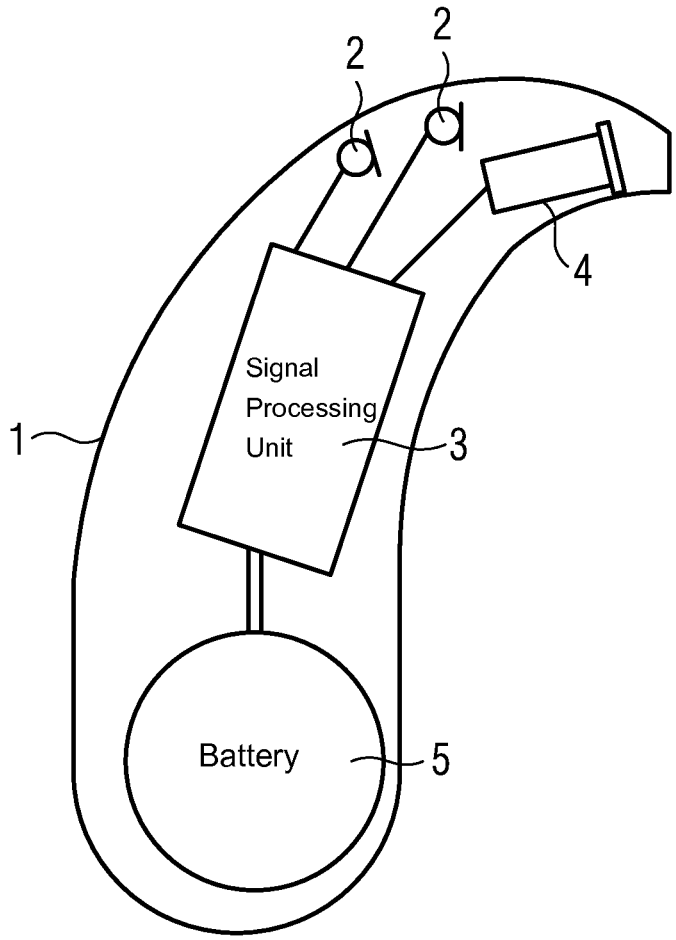
FIG 1 PRIOR ART
FIG. 1 shows the fundamental structure of a hearing aid according to the prior art.
Figure 2:
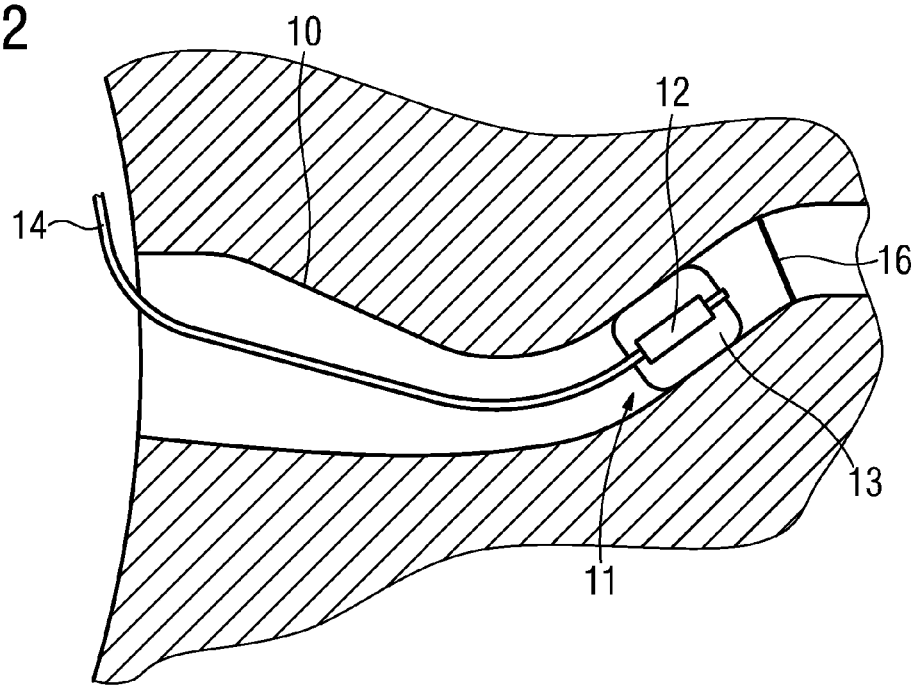
FIG. 2 shows a receiver in the auditory canal with an inflatable balloon.

FIG. 2 illustrates an auditory canal 10 in which a so-called 'external receiver' 11 is positioned. This external receiver 11 is part of an RIC hearing aid as per FIG. 3. It consists essentially of the actual receiver 12 and a balloon 13 which encloses the receiver 12. The illustration in FIG. 2 is purely schematic in this case.

The receiver 12 is triggered by means of electrical signals via a line 14. The line here leads to the actual hearing aid 15 (cf. FIG. 3), for example, though this is not illustrated in FIG. 2.

The balloon 13 encloses the receiver 12 completely here. However, this is not obligatory. The essential aspect is that the balloon 13 can close at least part of the auditory canal around/at the receiver 12 or around a sound tube, such that less sound or no more sound can reach the eardrum 16 from the exterior. The balloon 13 is inflated by a pump device (not shown in FIG. 2). This pump device 20 can be arranged in the hearing aid 15, i.e. outside the auditory canal 10, or at the receiver 12. In the first case, the line 14 or a tube running parallel therewith must accordingly also carry air from the hearing aid that is worn in the auditory canal 10 or behind the ear to the balloon 13. In the second case, it must be possible to trigger the pump device accordingly. The pump device can be developed using the loudspeaker and corresponding valves, for example, wherein the balloon can be inflated in this case by means of low-frequency sound as per the publication US 2009/0028356 A1.

Figure 3:
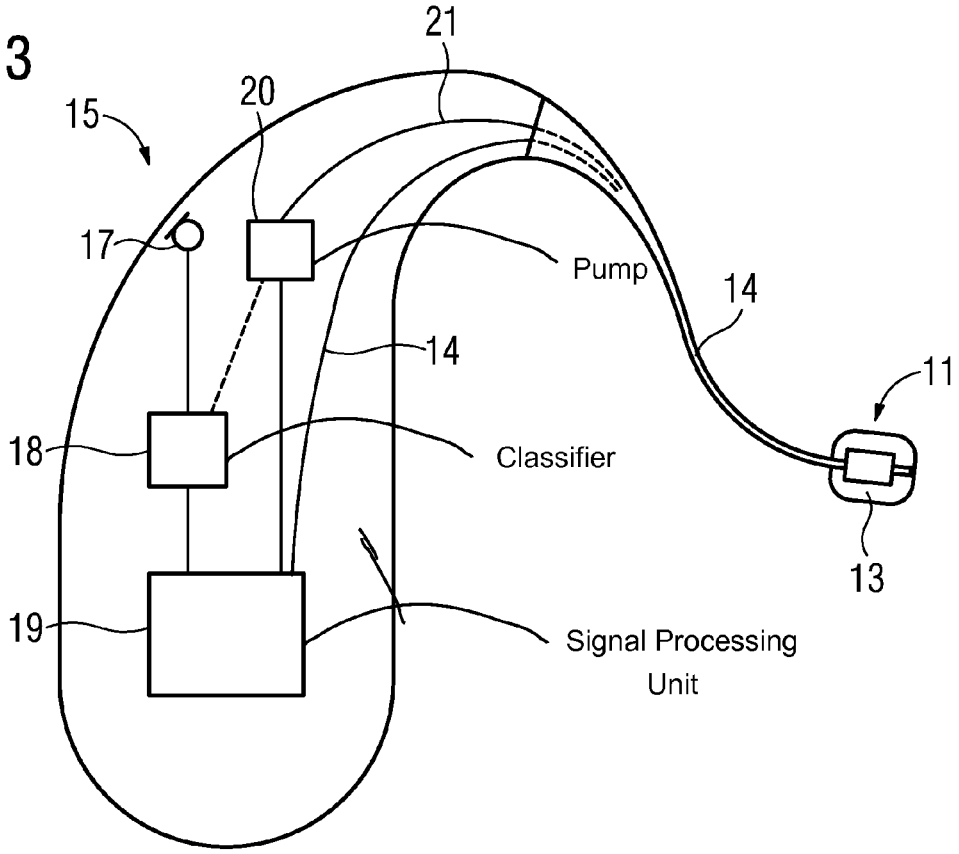
FIG. 3 shows an RIC hearing aid according to the present invention.

The structure of a BTE hearing aid 15 as per the present invention is schematically illustrated in FIG. 3 as mentioned above. The hearing aid 15 has a microphone 17 whose signal is supplied to a classifier 18. The classifier transfers a corresponding classification result to a further signal processing unit 19. This is used to e.g. filter, amplify, etc. the microphone signal and to trigger the external receiver 11. The signal line 14 is provided for this purpose.

In addition, the hearing aid 15 here has a pump device 20 by means of which the balloon 13 of the external receiver 11 can be inflated. The pump device 20 can also be triggered directly by the classifier 18 (broken line in FIG. 3). The air that is required for the balloon 13 can be transported by the pump device 20 through a tube 21 that runs parallel with the line 14 to the balloon 13. Alternatively, as suggested above, the pump device 20 can also be realized as a simple triggering device. In other words, the actual pump is located in the external receiver 11, for example, and is merely triggered by the pump control device 20. In this case, the hearing aid features a corresponding electrical conductor instead of the air tube 21.

As mentioned above, hearing aids already exist which inflate in the auditory canal when active and amplify the sound. A closed adaptation is therefore possible in the inflated state, and an open adaptation is possible in the empty state.

However, the fundamental idea of the invention is to adapt the size of the vent according to the situation during use. The larger the required size of the vent, the less the balloon must be inflated. However, in order to allow an adaptation according to the situation, it is necessary for the hearing aid to detect the current hearing situation. If the hearing aid or the classifier 18 identifies an interference noise in the current hearing situation, the size of the vent is reduced by inflating the balloon 13. The registration of an interference noise situation can be done by means of the classifier, or alternatively also by means of a simple SNR (signal-to-noise ratio) measurement. A classifier is no longer required as a detection device in the latter case, as an SNR measuring device is then sufficient.

Hearing situations can be divided into various classes. For example, the following classes of noises are distinguished: driving noise in a motor vehicle, quiet, voice, voice in interference noise, interference noise and music. The size of the balloon can be controlled as a function of these classes, wherein intermediate sizes between completely empty and completely inflated can also be achieved. The classifier (or the detection device generally) then produces a value (e.g. a classification result) that is specific to the hearing situation as a function of the class that has been detected. However, this specific value can also be the result of an SNR measurement.

In a particular embodiment, the detection device can also recognize a mixture of noises and supply a plurality of specific values for the hearing situation accordingly. An appropriate triggering value for the balloon must then be generated from this plurality of values. This can be achieved by weighting the detection values or classification values in a particular way, for example. If the hearing aid has a classifier and an SNR measuring device, for example, and the classifier detects 'voice of wearer' while the SNR measuring device detects interference noise in the current hearing situation, the situation 'voice of wearer' is considered to take precedence and the vent is opened, even if it would otherwise be closed in the case of interference noise. In this way, different classification results that occur simultaneously can be hierarchically categorized.

A further application scenario for the automatic control of the vent or the balloon 13 is the receipt of an audio signal. For example, if the classifier 18 identifies the receipt of a wireless audio signal (the hearing aid wearer is making a telephone call or wants to listen to music, for example), it is normally advantageous for the vent to be as small as possible or closed. The balloon can therefore be set to the appropriate size automatically as a function of the received audio signal in this case.

In the 'voice of wearer' case, particularly in a quiet environment situation, the hearing aid will increase the size of the vent adaptively, i.e. reduce the size of the balloon.

In a further exemplary embodiment, the feedback can be controlled automatically by means of the vent. If a feedback situation is specifically detected by a feedback detector, the vent size can be reduced automatically, for example, in order ultimately to reduce the feedback. This automatic feedback control using the balloon 13, like any other control function of the balloon 13, can be learned automatically. For example, if the same hearing situation actually occurs every day at the same time, and in this case a feedback whistle is always produced in this situation, the size of the vent can already be changed in advance before this situation occurs.

According to the invention, the balloon is therefore not always inflated when the hearing aid is worn, but only when a closed adaptation or a closed vent is necessary, e.g. in the case of audio reception or interference noise. On the basis of the current hearing situation that has been detected, a specific acoustic signal which inflates the balloon can be activated or deactivated at the receiver.

The invention claimed is:

1. A method for operating a hearing aid, the method comprising the following steps:

providing a hearing aid having a hearing aid component configured to be worn in a human auditory canal and a balloon having a variable size and at least partially enclosing the hearing aid component;

detecting a value specific to a current hearing situation with the hearing aid during operation of the hearing aid;

relating the specific value to a presence of a voice of a wearer of the hearing aid;

setting the size of the balloon as a function of the detected value; making the balloon smaller when the wearer of the hearing aid is speaking; and automatically learning, with the hearing aid, at what time or at what specific value the balloon is made smaller, before a feedback effect occurs above a predetermined threshold.

2. The method according to claim 1, which further comprises relating the specific value to an interference noise and changing the size of the balloon accordingly.

3. The method according to claim 1, which further comprises determining the specific value by a classifier of the hearing aid.

4. The method according to claim 1, which further comprises determining the specific value by a signal-to-noise ratio measurement.

5. The method according to claim 1, which further comprises supplying the specific value by an audio receiving unit of the hearing aid.

6. A method for operating a hearing aid, the method comprising the following steps:

providing a hearing aid having a hearing aid component configured to be worn in a human auditory canal and a balloon having a variable size, at least partially enclosing the hearing aid component and determining a vent size;

detecting a value specific to a current hearing situation with the hearing aid during operation of the hearing aid;

supplying the specific value by a feedback detector of the hearing aid;

reducing the vent size when a feedback situation is detected by the feedback detector; and automatically learning, with the hearing aid, at what time or at what specific value the balloon is made smaller, before a feedback effect occurs above a predetermined threshold.

7. A hearing aid, comprising:

a hearing aid component configured to be worn in a human auditory canal;

a balloon having a variable size and at least partially enclosing said hearing aid component;

a detection device configured to detect a value specific to a current hearing situation during operation of the hearing aid and to relate the specific value to a presence of a voice of a wearer of the hearing aid, and automatically learning, with the hearing aid, at what time or at what specific value the balloon is made smaller, before a feedback effect occurs above a predetermined threshold; and a pump device communicating with said detection device and said balloon and configured to set the size of said balloon according to the detected value and to make said balloon smaller when the wearer of the hearing aid is speaking.

* * * * *